US006848135B1

(12) United States Patent
Kohlman

(10) Patent No.: US 6,848,135 B1
(45) Date of Patent: Feb. 1, 2005

(54) INFLATION LEVEL MONITORING SYSTEM FOR INFLATABLE CUSHIONS

(75) Inventor: Steve Kohlman, Clarks Grove, MN (US)

(73) Assignee: Aquila Corporation of Wisconsin, Clarks Grove, MN (US)

( * ) Notice: Subject to any disclaimer, the term of this patent is extended or adjusted under 35 U.S.C. 154(b) by 0 days.

(21) Appl. No.: 10/353,514

(22) Filed: Jan. 29, 2003

(51) Int. Cl.[7] ..... A61G 7/057
(52) U.S. Cl. ..... 5/654; 5/713
(58) Field of Search ..... 5/713, 654

(56) References Cited

U.S. PATENT DOCUMENTS

| | | | | | |
|---|---|---|---|---|---|
| 2,998,817 | A | | 9/1961 | Armstrong | 128/33 |
| 3,148,391 | A | | 9/1964 | Whitney | 5/348 |
| 4,175,297 | A | | 11/1979 | Robbins et al. | 5/284 |
| 4,912,788 | A | | 4/1990 | Lonardo | 5/432 |
| 5,052,068 | A | | 10/1991 | Graebe | 5/455 |
| 5,103,518 | A | | 4/1992 | Gilroy et al. | 5/453 |
| 5,109,560 | A | | 5/1992 | Uetake | 5/453 |
| 5,163,196 | A | | 11/1992 | Graebe et al. | 5/654 |
| 5,390,384 | A | | 2/1995 | Dinsmoor, III et al. | 5/654 |
| 5,427,331 | A | | 6/1995 | Stroud | 244/122 |
| 5,473,313 | A | * | 12/1995 | Graebe, Jr. | 340/626 |
| 5,487,197 | A | | 1/1996 | Iskra, Jr. et al. | 5/654 |
| 5,500,965 | A | | 3/1996 | Hannagan et al. | 5/654 |
| 5,613,257 | A | | 3/1997 | Graebe | 5/654 |
| 5,687,438 | A | * | 11/1997 | Biggie et al. | 5/654 |
| 5,701,622 | A | | 12/1997 | Biggie et al. | 5/713 |
| 5,839,140 | A | | 11/1998 | Wilkerson | 5/654 |
| 5,845,352 | A | | 12/1998 | Matsler et al. | 5/654 |
| 5,963,997 | A | | 10/1999 | Hagopian | 5/654 |
| 6,014,784 | A | | 1/2000 | Taylor et al. | 5/713 |
| 6,092,249 | A | * | 7/2000 | Kamen et al. | 5/653 |
| 6,094,762 | A | | 8/2000 | Viard et al. | 5/713 |
| 6,216,299 | B1 | * | 4/2001 | Kohlman | 5/654 |
| 6,392,166 | B1 | | 5/2002 | Fortune et al. | 177/144 |
| 2002/0128572 | A1 | | 9/2002 | Chang | 601/148 |

* cited by examiner

*Primary Examiner*—Michael Trettel
(74) *Attorney, Agent, or Firm*—Sherrill Law Offices, PLLC

(57) ABSTRACT

A monitoring system for monitoring inflation pressure within an inflatable cushion. The monitoring system includes a housing, a pneumatic tube, a locking adaptor and a sensing and signaling system. The pneumatic tube extends through the housing with the locking adaptor attached to the distal end of the pneumatic tube. The locking adaptor is effective for releasably and sealingly attaching the pneumatic tube to a stem valve on an inflatable cushion. The sensing and signaling is retained within the housing and includes at least a pressure sensor in pneumatic communication with the pneumatic tube proximate a proximal end of the pneumatic tube, and a means in communication with the pressure sensor for generating a perceptible signal when the pressure sensed by the pressure sensor falls below a predetermined threshold value.

10 Claims, 1 Drawing Sheet

INFLATION LEVEL MONITORING SYSTEM FOR INFLATABLE CUSHIONS

FIELD OF THE INVENTION

The invention relates to systems for monitoring inflation pressure in inflatable cushions.

BACKGROUND

Patients confined to wheelchairs face the prospect of developing decubitus ulcers or "bed sores" on their buttocks. These ulcers form at bony locations when prolonged sitting pressure reduces blood circulation below the level required to sustain tissue life. Skin breakdown can also occur when the patient is seated on a wheelchair cushion that does not provide adequate ventilation and causes the skin to remain excessively moist and warm for protracted periods. A healthy subject seated for a prolonged period in a single position will sense discomfort and eventually pain from the reduced blood circulation, and will change positions. However, if the patient is paralyzed, disoriented, sick or otherwise disabled, they may be unaware of the discomfort or pain, or may be unable to change position.

Various wheelchair cushions are commercially available for reducing the risk of developing "bed sores" by spreading the person's weight over as much area as possible. Such cushions include inflatable cushions, fluid-filled cushions, gel filled cushions, foam cushions and combinations thereof. As a general matter, gel-filled and foam cushions provide a soft surface but do little to reduce pressure exerted upon the bony regions of the buttock and contribute to moisture and heat build up. Fluid filled cushions (e.g., cushions filled with water) help reduce the pressure exerted upon the bony regions of the buttock, but are heavy and subject to leaking of the fluid. Inflatable cushions (e.g., cushions filled with pressurized air) are lightweight and help reduce the pressure exerted upon the bony regions of the buttock. However, inflatable cushions are also subject to leaking, with a resultant loss in effectiveness and eventual "bottoming out" of the person seated on the cushion (i.e., direct contact between the person and the seat of the chair). Failure to reinflate the cushion to the proper pressure for an extended period of time can eventually lead to the development of "bed sores".

Cushion inflation monitoring systems are known, such as the system described in U.S. Pat. No. 5,487,197. However, such inflation monitoring systems are customized for use with a particular type and style of cushion. Persons confined to wheelchairs spend a significant portion of the day seated in the wheelchair, and are understandably sensitive to selecting just the right cushion.

Hence, a need exists for an inflation monitoring system which can monitor the inflation pressure in a wide variety of inflatable cushions so as to provide persons with the benefit of an inflation pressure monitor in connection with a wider range of cushion types and styles.

SUMMARY OF THE INVENTION

A monitoring system for monitoring inflation pressure within an inflatable cushion. The monitoring system includes a housing, a pneumatic tube, a locking adaptor and a sensing and signaling system. The pneumatic tube extends through the housing with the locking adaptor attached to the distal end of the pneumatic tube. The locking adaptor is effective for releasably and sealingly attaching the pneumatic tube to a stem valve on an inflatable cushion. The sensing and signaling system is retained within the housing and includes at least a pressure sensor im pneumatic communication with the pneumatic tube proximate a proximal end of the pneumatic tube, and a means in communication with the pressure sensor for generating a perceptible signal when the pressure sensed by the pressure sensor falls below a predetermined threshold value.

DETAILED DESCRIPTION OF A PREFERRED EMBODIMENT

Nomenclature

10 Monitoring System
20 Housing
30 Sleeve
31 Hook and Loop Straps
40 Tube
40*d* Distal End of Tube
40*p* Proximal End of Tube
50 Locking Adaptor
60 Sensing and Signaling System
61 Microprocessor
62 Pressure Sensor
63 LED(s)
64 Speaker
65 Vibrator
66 On/Off Switch
67 Battery
70 Pump
80 Relief Valve
90 Quick Disconnect
100 Inflatable Cushion
110 Stem Valve.

Description

Figure 1:
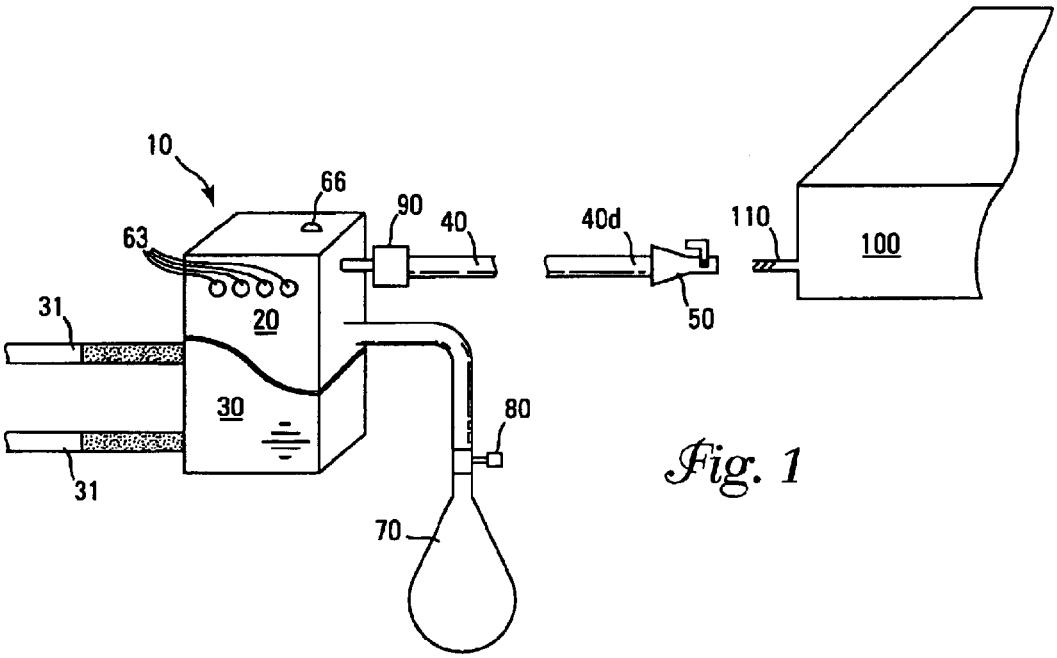
FIG. 1 is a perspective view of one embodiment of the invention in combination with an inflatable cushion.

Referring generally to FIG. 1, the invention is a monitoring system 10 for monitoring inflation pressure within an inflatable cushion 100. The embodiment of the monitoring system 10 shown in FIGS. 1 and 2 includes a housing 20, a sleeve 30, a pneumatic tube 40, a locking adaptor 50, a sensing and signaling system 60, a pump 70 and a relief valve 80.

Figure 2:
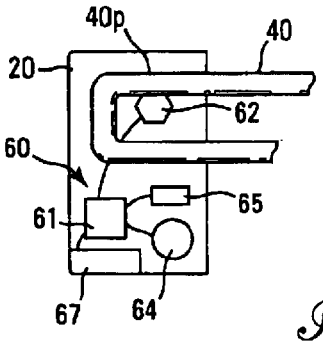
FIG. 2 is a schematic view of one embodiment of a sensing and signaling system of the invention.

As illustrated schematically in FIG. 2, the sensing and signaling system 60 includes a microprocessor 61, a pressure sensor 62, a means for generating a perceptible signal, and a power source (e.g., a battery 67). The pressure sensor 62 is in fluid communication with a tube 40 for sensing inflation pressure within the cushion 100 and in electrical communication with the microprocessor 61 for transmitting a signal indicative of the sensed inflation pressure. The microprocessor 61 is programmed to compare the sensed inflation pressure with a threshold value and generate a perceptible signal (e.g., red light, beep and/or vibration) when the sensed inflation pressure falls below the threshold value. Alternatively, a pressure switch (not shown) or a pressure transducer (not shown) may be substituted for the microprocessor 61, with a preference for a plurality of pressure switches each in fluid communication with the tube 40 and effective for generating a unique perceptible signal at different sensed pressures (e.g., a first pressure switch (not shown) remains closed so long as the sensed pressure is above a first threshold pressure value and thereby activates a first green LED 63 so long as the inflation pressure remains above the first threshold value, a second pressure switch (not shown) remains closed so long as the sensed pressure is above a second threshold pressure value—which is lower than the first threshold pressure value—and thereby activates a second green LED 63 so long as the inflation pressure remains above the second threshold value, a third pressure switch (not shown) remains closed so long as the sensed pressure is above a third threshold pressure value which is lower than the first and second threshold pressure values—and thereby activates a third green LED 63 so long as the inflation pressure remains above the second threshold value, and a fourth pressure switch (not shown) set to close at a fourth threshold pressure value—which is lower than the first, second and third threshold pressure values—and thereby activates a red LED 63 only when the inflation pressure decreases below the fourth and final threshold value.)

Various means for generating a perceptible signal are shown in FIG. 1, including an LED 63 for providing a visual signal, a speaker 64 for providing an audible signal, and a vibrator 65 for providing a tactile signal. As shown in FIG. 1, a preferred perceptible signal is a series of LEDs 63 with the LEDs 63 sequentially switched ON by the microprocessor 61 as the inflation pressure decreases. By way of non-limiting example, a green LED 63 remains ON until the inflation pressure decreases below a first threshold value, at which time the green LED 63 is turned OFF and a yellow LED 63 is turned ON. If inflation pressure continues to decrease below a second threshold value, the yellow LED 63 is turned OFF and an orange LED 63 is turned ON. Finally, if inflation pressure continues to decrease below a third and final threshold value, the orange LED 63 is turned OFF and a red LED 63 is turned ON.

As shown in FIG. 1, the sensing and signaling system 60 is preferably housed in a weather resistant protective housing 20. Housing 20 is preferably constructed from metal or plastic and retained within a sleeve 30 having a means for mounting the housing 20 to a wheelchair (not shown). Housing 20 is preferably less than 40 $in^3$ in size, most preferably less than 20 $in^3$ in size, to facilitate attachment to the frame of a wheelchair in a convenient location. The mounting means may be selected from any of the well known means for attaching such items to a frame (not shown), including metal fittings, metal clips, tie straps, twist straps, male/female snaps, hook and loop tape, etc. As shown in FIG. 1, a preferred mounting means is a pair of hook and loop straps 31.

Flexible tubing 40 extends through the housing 20 with a proximal end 40*p* positioned within the housing 20 for communication with the pressure sensor 62. A locking adaptor 50 is sealingly attached to the distal end 40*d* of the flexible tubing 40. Locking adaptor 50 is effective for releasably and sealingly securing the flexible tubing 40 to a valve stem 110 on an inflatable cushion 100. One embodiment of an acceptable locking adaptor 50, shown in FIG. 1, includes a lever (unnumbered) pivotable between a clamping position and a release position. An alternative embodiment, not shown, is for the distal end 40*d* of the tube 40 to be sized relative to the stem 110 such that the tube 40 can be friction fitted over the stem 110. The tube 40 can then optionally be secured onto the stem 110 by a cable tie (not shown) or other suitable clamping mechanism. Other embodiments for securing the tube 40 to the stem 110 are known to those skilled in the art and can also be employed.

What is claimed is:

1. A monitoring system for monitoring inflation pressure within an inflatable cushion, comprising:

(a) a housing, (b) a pneumatic tube extending through the housing, (c) a locking adaptor attached to a distal end of the pneumatic tube effective for releasably and sealingly attaching the pneumatic tube to a stem valve on an inflatable cushion, and (d) a sensing and signaling system retained within the housing and including at least:

(1) a pressure sensor in pneumatic communication with the pneumatic tube proximate a proximal end of the pneumatic tube, and (2) a means in communication with the pressure sensor for generating a perceptible signal when the pressure sensed by the pressure sensor falls below a predetermined threshold value, without initiating automatic inflation of the inflatable cushion.

2. The monitoring system of claim 1 further comprising a means for releasably attaching the housing to a frame.

3. The monitoring system of claim 2 wherein the means for releasably attaching the housing to a frame is a sleeve configured and arranged to retain the housing and having at least one hook and loop strap.

4. The monitoring system of claim 1 further comprising an inflation means in pneumatic communication with the tube.

5. The monitoring system of claim 4 wherein the inflation means is a manual pump.

6. The monitoring system of claim 1 further comprising a release valve in pneumatic communication with the tube.

7. The monitoring system of claim 1 wherein the housing is less than 40 cubic inches in size.

8. The monitoring system of claim 1 wherein the perceptible signal is a visual signal.

9. The monitoring system of claim 1 wherein the perceptible signal is an audible signal.

10. The monitoring system of claim 1 wherein the perceptible signal is a tactile signal.

* * * * *